US006912758B1

(12) United States Patent
Jang

(10) Patent No.: US 6,912,758 B1
(45) Date of Patent: Jul. 5, 2005

(54) 3-DIMENSIONAL HINGE

(76) Inventor: Yeong-An Jang, 3F., No. 30, Alley 3, Lane 379, Chung Cheng Rd., Pan-Chiao City (TW)

( * ) Notice: Subject to any disclaimer, the term of this patent is extended or adjusted under 35 U.S.C. 154(b) by 56 days.

(21) Appl. No.: 10/762,232

(22) Filed: Jan. 23, 2004

(51) Int. Cl.[7] ..... E05D 5/02
(52) U.S. Cl. ..... 16/388; 16/384; 16/387; 16/234
(58) Field of Search ..... 16/388, 389, 387, 16/383, 384, 382, 365, 234; 411/470, 475, 411/473, 457

(56) References Cited

U.S. PATENT DOCUMENTS

| | | | | | |
|---|---|---|---|---|---|
| 312,947 | A | * | 2/1885 | Andrews | 16/388 |
| 2,188,670 | A | * | 1/1940 | Wagner | 16/384 |
| 2,578,612 | A | * | 12/1951 | Stregack | 150/120 |
| 2,648,486 | A | * | 8/1953 | Young | 229/125.11 |
| 2,714,741 | A | * | 8/1955 | Derman et al. | 16/384 |
| 3,201,820 | A | * | 8/1965 | Desrosiers | 16/277 |
| 4,034,512 | A | * | 7/1977 | Lindal | 49/501 |
| 4,406,035 | A | * | 9/1983 | Schmale | 16/384 |
| 4,850,082 | A | * | 7/1989 | Yi | 16/341 |
| 5,005,256 | A | * | 4/1991 | Jang | 16/384 |

FOREIGN PATENT DOCUMENTS

| | | | | |
|---|---|---|---|---|
| WO | WO 9006413 | A1 | * 6/1990 | E05D 5/00 |

* cited by examiner

*Primary Examiner*—Chuck Y. Mah
(74) *Attorney, Agent, or Firm*—Troxell Law Office, PLLC

(57) ABSTRACT

A 3-dimensional hinge is constructed to include a shaft, top and bottom adjustment screws respectively threaded into the top and bottom sides of the shaft, upper and lower left-hand leaves and right-hand leaves respectively coupled to the threaded shanks of the adjustment screws for striking into two wooden members to connect the two wooden members together for permitting one wooden member to swing about the other, the upper right-hand leaf and the lower left-hand leaves being respectively coupled to the adjustment screws by a slip joint for permitting the two wooden members to be adjusted horizontally relative to each other during installation of the hinge., the upper and lower left-hand leaves and right-hand leaves each having a stop element for guiding the positioning during installation, and bearings respectively sleeved onto the adjustment screws and supported between the upper and lower left-hand leaves and the upper and lower right-hand leaves to reduce noise during operation of the hinge.

2 Claims, 6 Drawing Sheets

3-DIMENSIONAL HINGE

BACKGROUND AND SUMMARY OF THE INVENTION

The present invention relates to a hinge and, more particularly, to a simple and inexpensive 3-dimensional hinge that can conveniently be adjusted leftwards, rightwards, upwards, as well as downwards during installation and, that produces less noise during operation.

U.S. Pat. No. 5,005,256 discloses a structure of hinge. This structure of hinge has numerous drawbacks as follows:

1. When going to strike the pointed teeth of the two pivoted parts of the hinge 9 into swinging door and door frame 90, the elevational position of the two pivoted parts cannot be adjusted relative to each other to let the swinging door be precisely secured to the door frame in position.
2. The left-hand part 91 and right-hand part 92 are rectangular frame members that have a complicated structure and a high material cost, in consequence the mold for making the two pivoted parts 91 and 92 of the hinge 9 is expensive.
3. The left-hand part 91 and right-hand part 92 of the hinge 9 have pointed teeth 911 or 921 extending therefrom at the back around three of the four sides. When striking the pointed teeth 911 and 921 into the wooden swinging door and door frame 90, the wooden swinging door and door frame 90 may be damaged easily.
4. When the user opening/closing the swinging door after installation of the hinge, much noise is produced.

Therefore, it is desirable to provide a 3-dimensional hinge that eliminates the aforesaid drawbacks.

The present invention has been accomplished under the circumstances in view. According to one aspect of the present invention, the 3-dimensional hinge is comprised of a shaft, top and bottom adjustment screws respectively threaded into the top and bottom sides of the shaft, upper and lower left-hand leaves and right-hand leaves respectively coupled to the threaded shanks of the adjustment screws for striking into a first wooden member, the upper right-hand leaf and the lower left-hand leaves being respectively coupled to the adjustment screws by a slip joint for permitting the wooden members to be adjusted horizontally relative to each other during installation of the hinge. The upper and lower left-hand leaves and right-hand leaves each have a stop element for guiding the positioning during installation. According to another aspect of the present invention, the upper and lower left-hand leaves and right-hand leaves are respectively stamped from a metal plate member to reduce the manufacturing cost. According to still another aspect of the present invention, two bearings are respectively sleeved onto the adjustment screws and supported between the upper and lower left-hand leaves and the upper and lower right-hand leaves to reduce noise during operation of the hinge.

DETAILED DESCRIPTION OF THE INVENTION

Figure 1:
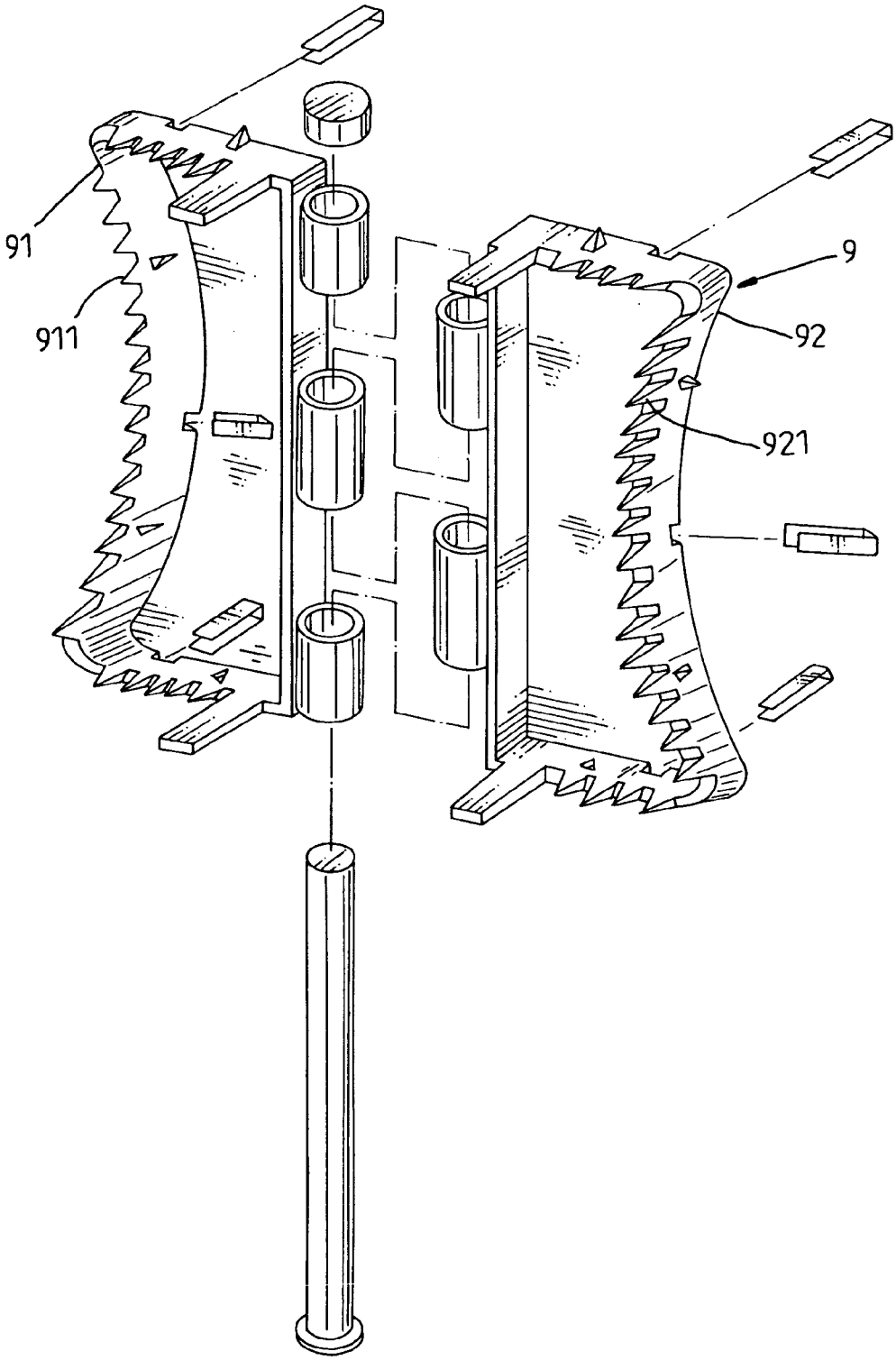
Fig. 1 PRIOR ART
FIG. 1 is an exploded view of a structure of hinge according to U.S. Pat. No. 5,005,256.
Figure 2:
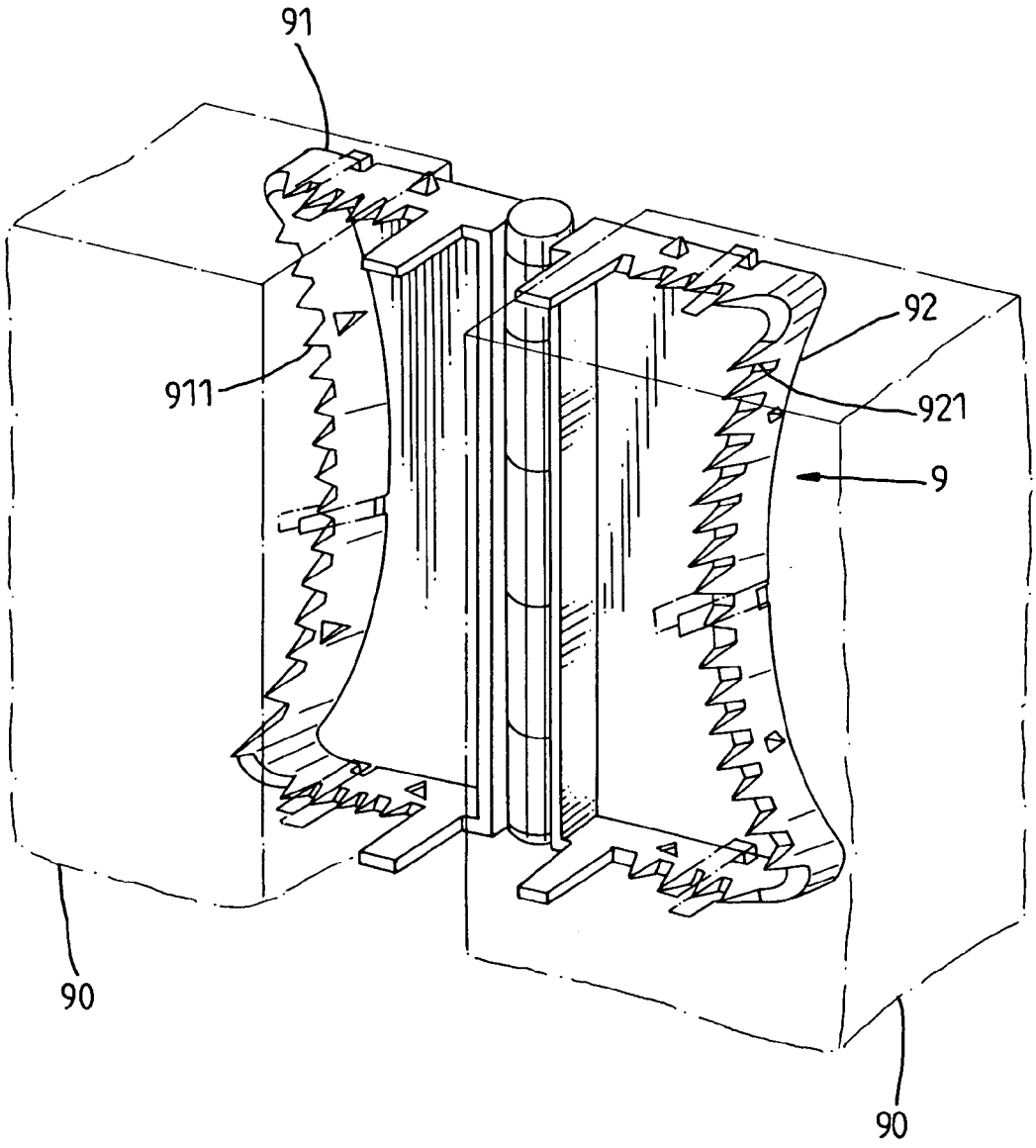
Fig. 2 PRIOR ART
FIG. 2 is an assembly view of the structure of hinge according to U.S. Pat. No. 5,005,256.
Figure 3:
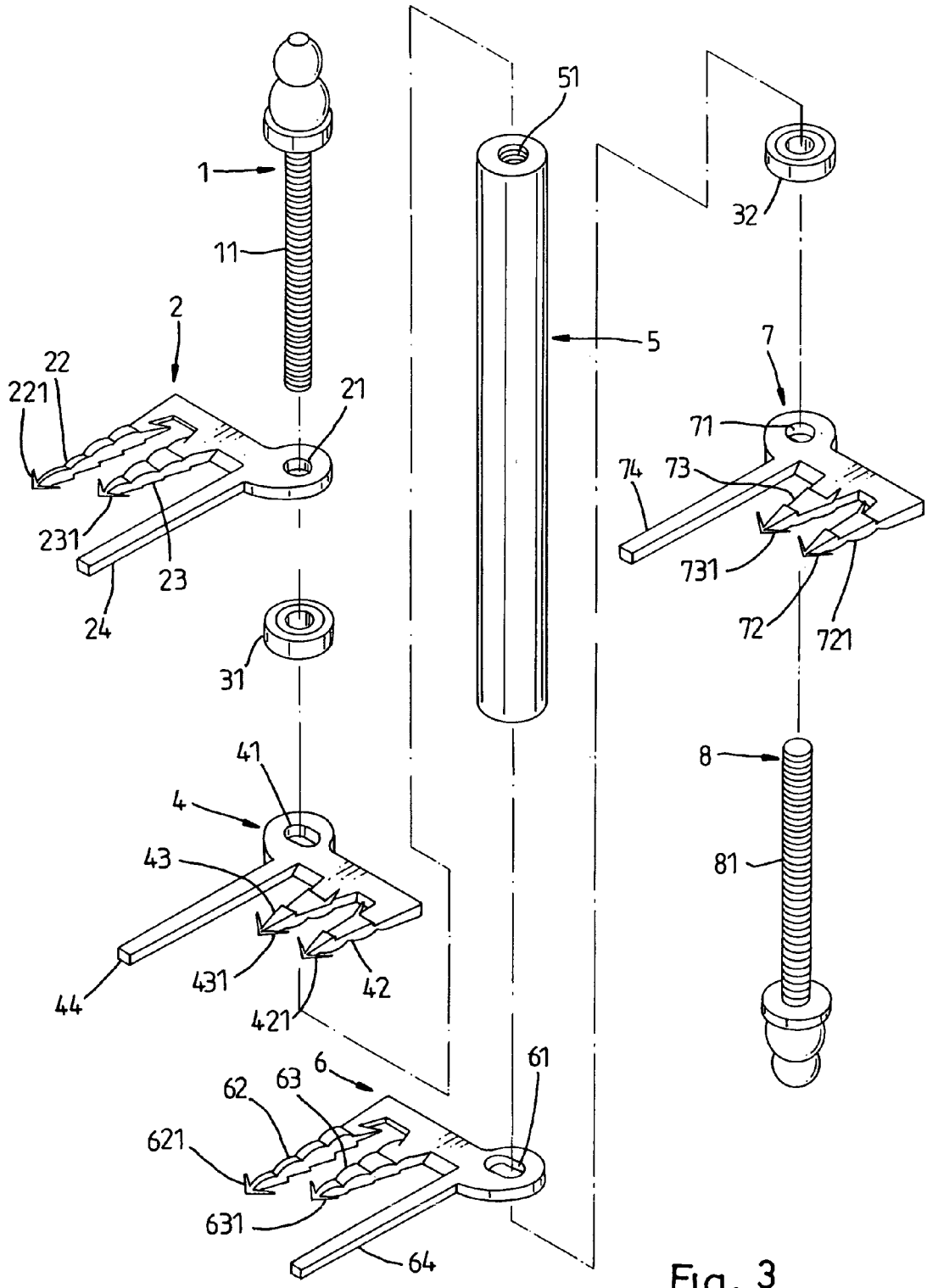
FIG. 3 is an exploded view of a 3-dimensional hinge according to the present invention.
Figure 4:
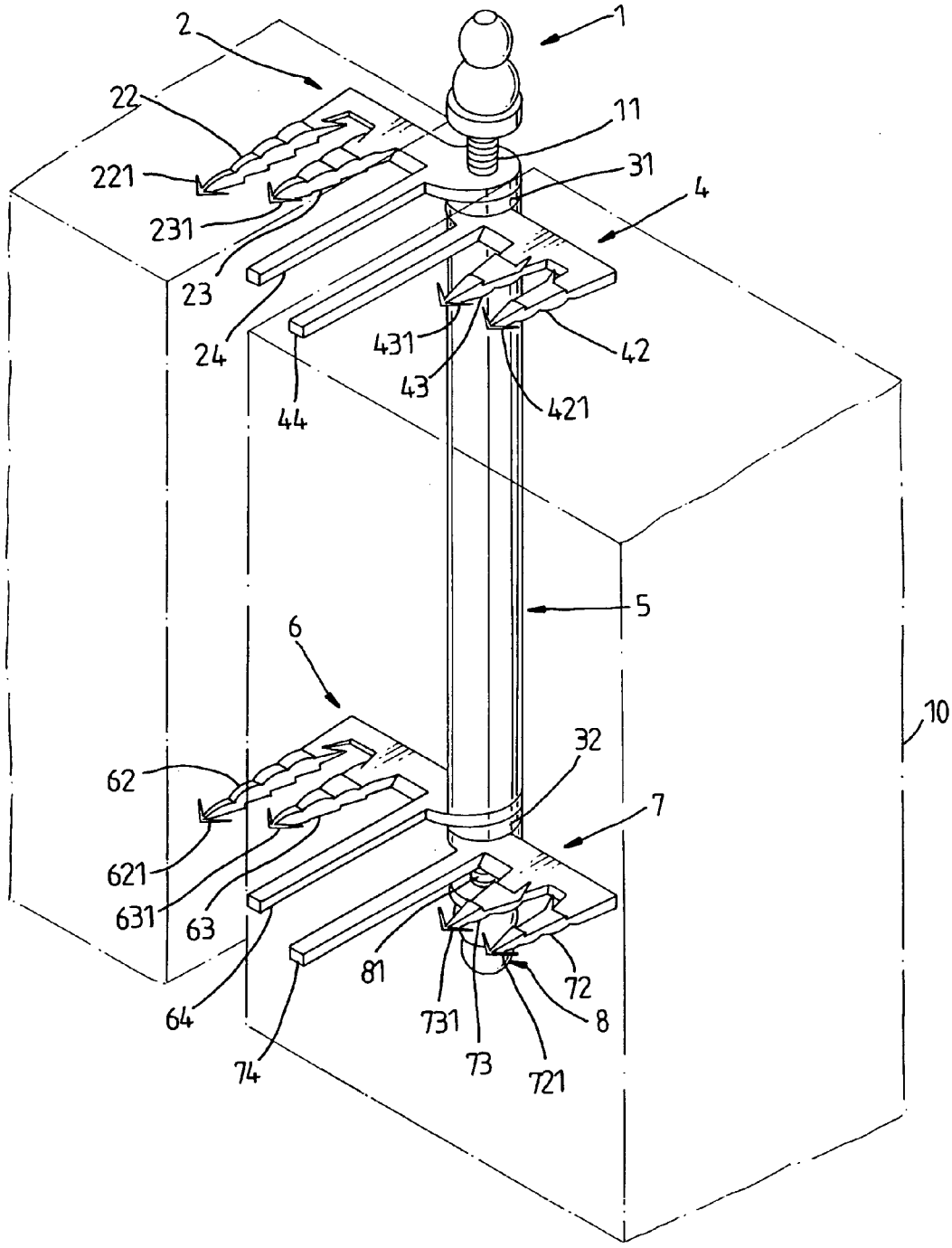
FIG. 4 is an assembly view of the 3-dimensional hinge according to the present invention.
Figure 5:
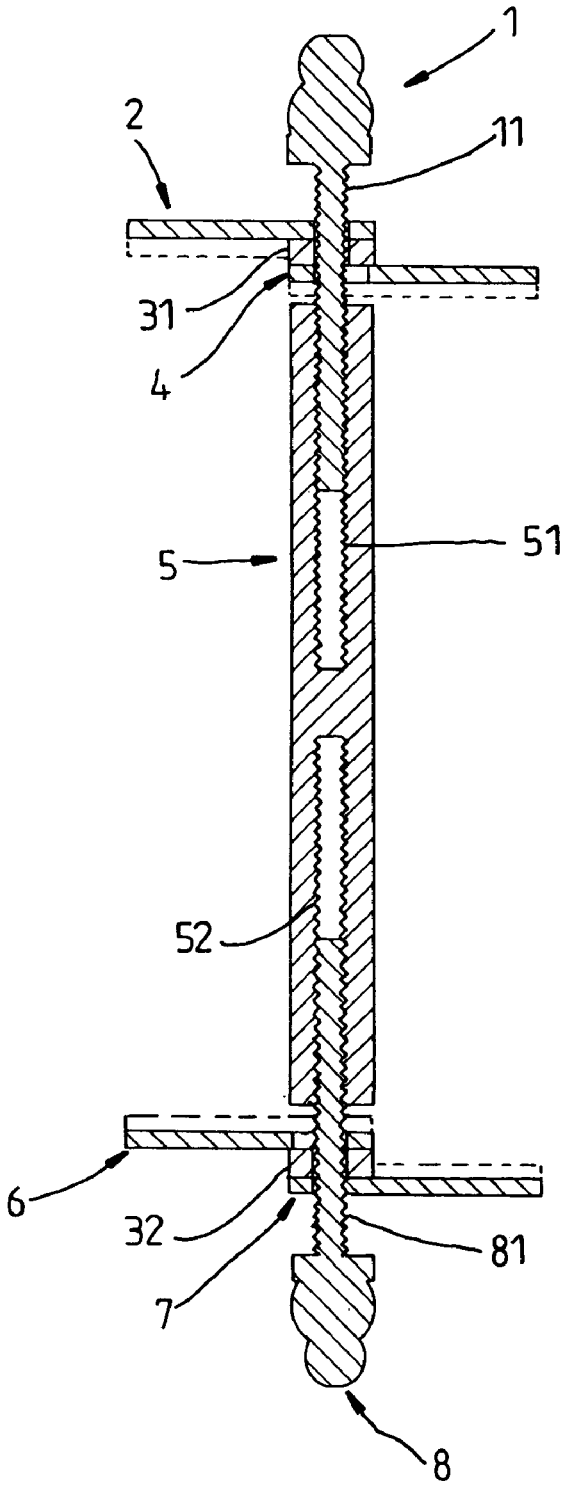
FIG. 5 is a sectional view of the 3-dimensional hinge according to the present invention.

Referring to FIGS. 3~6, a 3-dimensional hinge is shown adapted to connect two wooden objects 10 (for example, a wooden swinging door and a wooden door frame) together, permitting one (the swinging door) to swing against the other (the wooden door frame). The 3-dimensional hinge is comprised of a top adjustment screw 1, an upper left-hand leaf 2, a top bearing 31, an upper right-hand leaf 4, a shaft 5, a lower left-hand leaf 6, a bottom bearing 32, a lower right-hand leaf 7, and a bottom adjustment screw 8.

The top adjustment screw 1 has a threaded shank 11 inserted downwards in proper order through the upper left-hand leaf 2, the top bearing 31 and the upper right-hand leaf 4, and then threaded into the top side of the shaft 5.

The bottom adjustment screw 8 has a threaded shank 81 inserted upwards in proper order through the lower right-hand leaf 7, the bottom bearing 32 and the lower left-hand leaf 6, and then threaded into the top side of the shaft 5.

The upper left-hand leaf 2 has a through hole 21 vertically disposed at one end for the passing of the top adjustment screw 1, a plurality of pointed teeth 22 and 23 horizontally forwardly extended therefrom at the front side for striking into one wooden object (for example, the wooden door frame), and a stop element 24 for stopping at one side of the wooden object (the wooden door frame) to guide the pointed teeth 22 and 23 into the wooden object during installation.

The top bearing 31 is sleeved onto the threaded shank 11 of the top adjustment screw 1, and stopped between the upper left-hand leaf 2 and the upper right-hand leaf 4.

The upper right-hand leaf 4 has an oblong through hole 41 vertically disposed at one end for the passing of the threaded shank 11 of the top adjustment screw 1, a plurality of pointed teeth 42 and 43 horizontally forwardly extended therefrom at the front side for striking into one wooden object (for example, the wooden swinging door), and a stop element 44 for stopping at one side of the wooden object (the wooden swinging door) to guide the pointed teeth 42 and 43 into the wooden object during installation.

The shaft 5 has a top screw hole 51 disposed at the top side and adapted to receive the threaded shank 11 of the top adjustment screw 1, and a bottom screw hole 52 (see FIG. 5) disposed at the bottom side and adapted to receive the threaded shank 81 of the bottom adjustment screw 8.

The lower left-hand leaf 6 has an oblong through hole 61 vertically disposed at one end for the passing of the threaded shank 81 of the bottom adjustment screw 8, a plurality of pointed teeth 62 and 63 horizontally forwardly extended therefrom at the front side for striking into one wooden object 10 (for example, the wooden door frame), and a stop element 64 for stopping at one side of the wooden object (the wooden door frame) to guide the pointed teeth 62 and 63 into the wooden object during installation.

The bottom bearing 32 is sleeved onto the threaded shank 81 of the bottom adjustment screw 8, and stopped between the lower left-hand leaf 6 and the lower right-hand leaf 7.

The lower right-hand leaf 7 has a through hole 71 vertically disposed at one end for the passing of the threaded shank 81 of the bottom adjustment screw 8, a plurality of pointed teeth 72 and 73 horizontally forwardly extended therefrom at the front side for striking into one wooden object (for example, the wooden swinging door), and a stop element 74 for stopping at one side of the wooden object (the wooden swinging door) to guide the pointed teeth 72 and 73 into the wooden object during installation.

Figure 6:
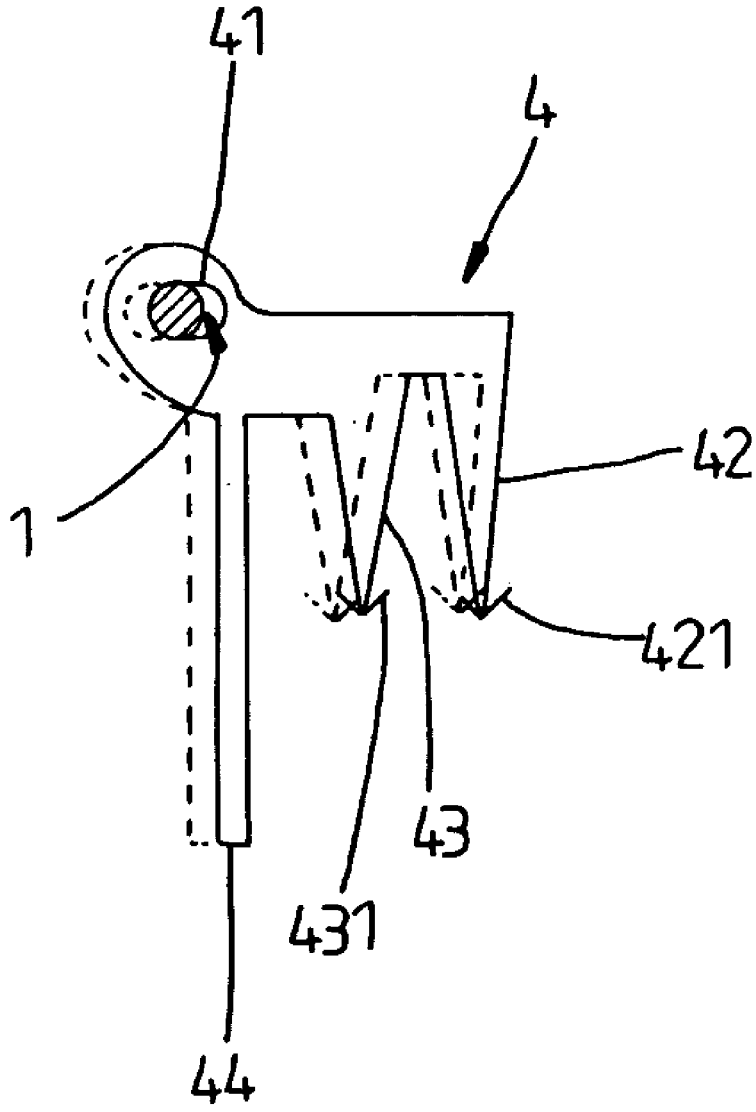
FIG. 6 is a schematic sectional view showing an adjustment example of the present invention.

By means of the oblong through hole 41 of the upper right-hand leaf 4 (see FIG. 6) and the oblong through hole 61 of the lower left-hand leaf 6, the wooden objects can be horizontally adjusted relative to each other (i.e., the wooden swinging door can be adjusted horizontally leftwards or rightwards relative to the wooden door frame; see the imaginary line in FIG. 6). By means of rotating the top adjustment screw 1 in the top side of the shaft 5 and the bottom adjustment screw 8 in the bottom side of the shaft 5 in clockwise or counter-clockwise direction, the relative vertical position between the wooden objects can be adjusted (see the imaginary line in FIG. 5). Because the leaves 2, 4, 6, and 7 are flat plate members, driving the pointed teeth of the leaves 2, 4, 6, and 7 into the wooden objects does not break the leaves 2, 4, 6, and 7 or cause the leaves 2, 4, 6, and 7 to deform. Because the leaves 2, 4, 6, and 7 are flat plate members, they can easily be made by stamping to reduce the cost. Because the top bearing 31 is supported between the upper left-hand leaf 2 and the upper right-hand leaf 4 and the bottom bearing 32 is supported between the lower left-hand leaf 6 and the lower right-hand leaf 7, the hinge produces less noise when operated.

Further, the pointed teeth 22 and 23 of the upper left-hand leaf 2, the pointed teeth 42 and 43 of the upper right-hand leaf 4, the pointed teeth 62 and 63 of the lower left-hand leaf 6, and the pointed teeth 72 and 73 of the lower right-hand leaf 7 each have a barbed tip 221, 231, 421, 431, 621, 631, 721, 731. When driven into the wooden objects, the barbed tip 221, 231, 421, 431, 621, 631, 721, 731 prohibit the respective pointed teeth 22,23;42,43; 62,63; 72,73 from backward displacement.

A prototype of 3-dimensional hinge has been constructed with the features of FIGS. 3~6. The 3-dimensional hinge functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A 3-dimensional hinge for connecting a first wooden member and a second wooden member together permitting one to swing about the other, the 3-dimensional hinge comprising:

a shaft, said shaft having a top screw hole in a top side thereof and a bottom screw hole in a bottom side thereof;

a top adjustment screw, said top adjustment screw having a threaded shank threaded into the top screw hole of said shaft;

a bottom adjustment screw, said bottom adjustment screw having a threaded shank threaded into the bottom screw hole of said shaft;

an upper left-hand leaf, said upper left-hand leaf having a through hole vertically disposed at one end thereof and coupled to the threaded shank of said top adjustment screw, a plurality of pointed teeth horizontally forwardly extended a front side thereof for striking into the first wooden member, and a stop element for stopping at one side of the first wooden member to guide the pointed teeth of the upper left-hand leaf into the first wooden member during installation;

an upper right-hand leaf, said upper right-hand leaf having an oblong through hole vertically disposed at one end thereof and coupled to the threaded shank of said top adjustment screw, a plurality of pointed teeth horizontally forwardly extended from a front side thereof for striking into the second wooden member, and a stop element for stopping at one side of the second wooden member to guide the pointed teeth of said upper right-hand leaf into the second wooden member during installation;

a top bearing sleeved onto the threaded shank of said top adjustment screw and stopped between said upper left-hand leaf and said upper right-hand leaf;

a lower left-hand leaf, said lower left-hand leaf having an oblong through hole vertically disposed at one end thereof and coupled to the threaded shank of said bottom adjustment screw, a plurality of pointed teeth horizontally forwardly extended a front side thereof for striking into the first wooden member, and a stop element for stopping at one side of the second wooden member to guide the pointed teeth of said lower left-hand leaf into the first wooden member during installation;

a lower right-hand leaf, said lower right-hand leaf having a through hole vertically disposed at one end thereof and coupled to the threaded shank of said bottom adjustment screw, a plurality of pointed teeth horizontally forwardly extended a front side thereof for striking into the second wooden member, and a stop element for stopping at one side of the second wooden member to guide the pointed teeth of said lower right-hand leaf into the second wooden member during installation; and a bottom bearing sleeved onto the threaded shank of said bottom adjustment screw and stopped between said lower left-hand leaf and said lower right-hand leaf.

2. The 3-dimensional hinge as claimed in claim 1, wherein the pointed teeth of said upper left-hand leaf, said upper right-hand leaf, said lower left-hand leaf and said lower right-hand leaf each have a barbed tip.

* * * * *